US006935585B1

(12) United States Patent
Hobson

(10) Patent No.: US 6,935,585 B1
(45) Date of Patent: Aug. 30, 2005

(54) GRINDING HEAD

(75) Inventor: Barry Reginald Hobson, North Lake (AU)

(73) Assignee: Eastbank Holdings Pty Ltd, Highgate (AU)

( * ) Notice: Subject to any disclaimer, the term of this patent is extended or adjusted under 35 U.S.C. 154(b) by 0 days.

(21) Appl. No.: 10/089,788

(22) PCT Filed: Oct. 13, 2000

(86) PCT No.: PCT/AU00/01243

§ 371 (c)(1),
(2), (4) Date: Oct. 28, 2002

(87) PCT Pub. No.: WO01/26814

PCT Pub. Date: Apr. 19, 2001

(30) Foreign Application Priority Data

Oct. 14, 1999 (AU) ..... PQ3416

(51) Int. Cl.[7] ..... B02C 17/00
(52) U.S. Cl. ..... 241/30; 241/84.3; 241/199.1

(58) Field of Search ..... 241/117, 118, 119, 241/228, 229, 221, 227, 226, 236, 84.3, 199.1, 241/30, 175; 100/213

(56) References Cited

U.S. PATENT DOCUMENTS

| | | | | |
|---|---|---|---|---|
| 4,640,468 | A * | 2/1987 | Quinn | 241/199.1 |
| 4,860,962 | A * | 8/1989 | Kiefer et al. | 241/117 |
| 5,524,840 | A * | 6/1996 | Gygi | 241/117 |
| 5,556,044 | A * | 9/1996 | Hobson | 241/296 |
| 6,209,809 | B1 * | 4/2001 | Mariutti | 241/30 |

* cited by examiner

*Primary Examiner*—Derris H. Banks
*Assistant Examiner*—Shelley Self
(74) *Attorney, Agent, or Firm*—William J. Sapone; Coleman Sudol Sapone PC

(57) ABSTRACT

A grinding head (10) includes a grinding bowl (12) provided with a boss (14) fixed to a bottom wall (16) of the bowl (12) and projecting into the bowl (12). The head (10) also includes a grinder ring (18) that is locatable over the boss (14) and freely moveable within the bowl (12). A lid (30) closes the bowl to prevent the escape of a mineral sample during grinding.

13 Claims, 9 Drawing Sheets

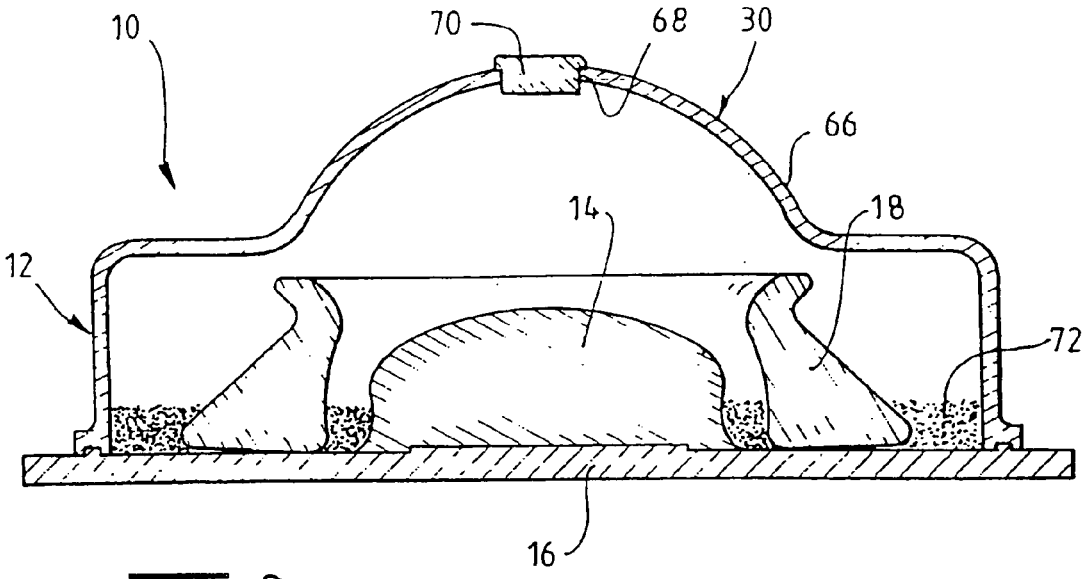
FIG. 9.
FIG. 10.
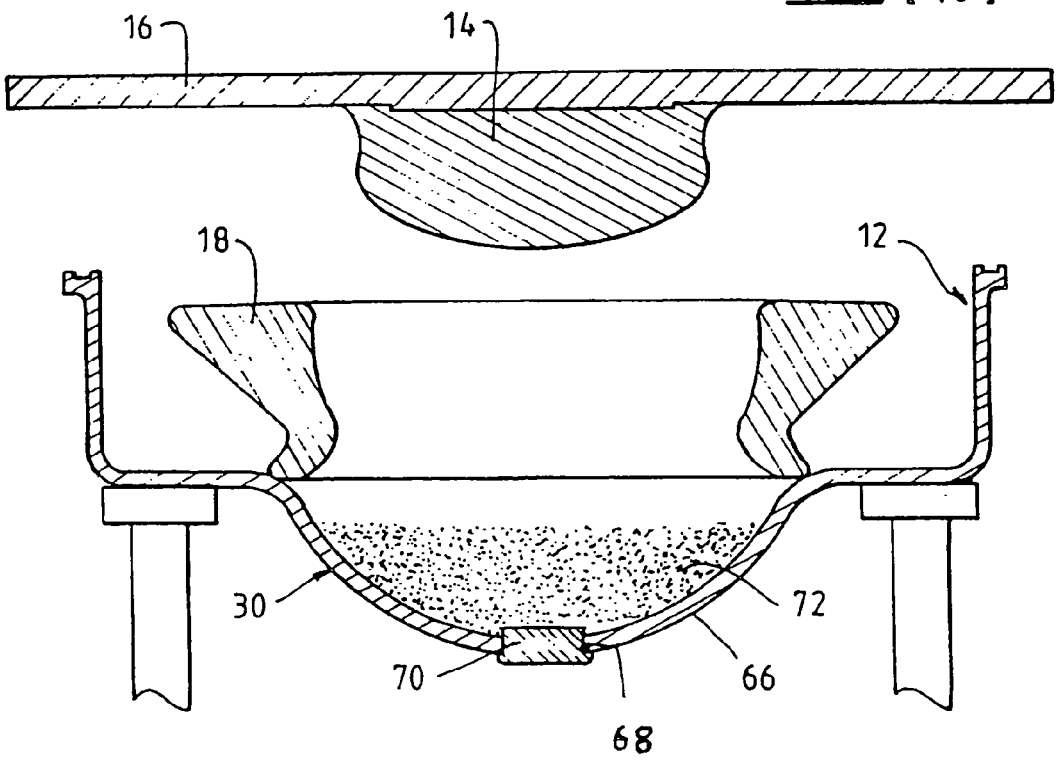

GRINDING HEAD

FIELD OF THE INVENTION

This invention relates to improvements in grinding heads for pulverising mills, particularly but not exclusively, used in geological sampling laboratories, and more particularly improvements in the bowl construction, grinding member and mounting arrangement.

BACKGROUND OF THE INVENTION

Pulverising mills are often used for grinding geological mineral ore samples into a fine powder for analysis of their mineral content. A typical pulverising mill comprises: a platform which is driven in a vibratory and oscillatory manner to produce a generally planar orbital motion; and, a grinding head which is held on the platform.

Grinding heads generally comprise a metal grinding bowl, a lid and grinding member in the form of either a freely movable grinding disc or an annular ring along with a solid cylinder within the ring or a set of rings. The bowl is placed or affixed on the platform and a mineral sample (charge) together with the disc or ring set placed within the bowl. The lid is then secured to the bowl.

When the mill is operated, the disc or ring set are effected by the movement of the platform and under centrifugal force orbit and roll against the internal side wall of the bowl, such that the sample is crushed and ground between the disc or ring set and bowl wall to a very fine particle size. Examples of pulverising mills and grinding heads are described in the specifications of Australian patent Nos 570814; 585751; 569895 and 594525.

The bowl is constructed in several different ways dependent on its volumetric capacity. When dealing with small volumetric samples, say less than 2 kg of ore, the bowl, disc, lid and sample can be manually removed from the pulverising mill after each grinding cycle. to be cleaned and replenished with the next sample or charge.

These bowls generally have a hardened, wear resistant, metallic, cylindrical side wall and an integrally formed base. They are clamped to the machine platform by way of a fast release clamp such as an air bellow mounted to a rigid overhead cross arm which moves in unison with the platform or a cam lock device or other means extending up from the platform. After each and every sample, the entire bowl and contents are removed from the pulverising mill for emptying, cleaning and re-loading of the next sample.

When volumetric size of the sample charge becomes greater, the physical size of the bowl must also be increased. These larger grinding bowls are generally fixed to the pulverising mill platform by a bolt-down flange mounting which is formed as an integral part of the bowl side wall. These bowls are generally removed from the pulverising mill platform only when the bowl requires replacement due to wear, which may be after many thousands of samples have been ground. The grinding bowls are constructed of expensive high grade, abrasive resistant steel and consist of generally a cylindrical side wall or skirt, a base (either being integral with or detachable from the side wall) and, in larger capacity bowls a mounting flange which is constructed as an integral part of the side wall or skirt. It is the bowl skirt or side-wall that causes high production costs due to the volume of high grade material required in its manufacture from one solid billet of steel.

Another deficiency in currently available grinding heads, in many laboratories around the world, is the need for the operator to physically lift the grinding disc or ring set from the bowl after every grinding cycle, as part of the process for sample collection and cleaning to eliminate any carry over sample that may contaminate the next sample. With the single discs sometimes weighing over 20 kg it becomes very draining on the operator to continually carry out this task. The ring set (in particular a set of three rings) reduces the strain of any individual lift by distributing the mass of the grinding media across three various size individual rings. Though in production terms this is a much slower process due to the number of items that have to be handled and cleaned after every sample grind.

Another deficiency in currently available grinding heads, which use ring sets, is the concentration of wear in the form of deep concentric grooves in the base of the bowl which results in premature failure of the base and low grinding efficiency. Analysis of the wear pattern indicates that the orbital path of the grinding rings whilst in motion is not of the intended horizontal, rolling, sliding pattern. Rather, after an initial somewhat random grinding motion, the rings settle very quickly into a rolling harmonic pattern with the inner wall of the bowl and the smaller rings within each other. One quadrant of the large ring presses down on the base plate with the diagonally opposite quadrant on its upper edge is in rolling contact with the under side of the lid. Therefore, the largest ring operates inclined to the horizontal base of the bowl.

The inner grinding ring rolls in harmony with the outer ring and because it derives its motion from the contact pressure against the inner diameter of the larger outer ring it tends to follow the angle of the large ring and thus it too rolls against the lid with only a point contact left in touch with the base of the bowl. This action greatly reduced the contact work area between the rings and the bowl, leading to a greatly reduced efficiency and excessive premature wear of the bowl base and lid.

Another deficiency in grinding heads that use a bowl and freely movable disc and or ring set is the need to use an overhead arm, which is attached to the moving platform, to clamp the lid firmly onto the bowl during the grinding cycle. The extra mass of the overhead arm effects the orbit pattern of the spring mounted platform due to its unbalanced arrangement.

Various aspects of the present invention were developed to address one or more of the above noted deficiencies in the prior art.

SUMMARY OF THE INVENTION

According to one aspect of the present invention there is provided a grinder head including at least:

- grinding bowl for holding a charge of material to be ground provided with a boss fixed to a bottom wall of the bowl and projected into the bowl; and,
- a grinder ring locatable over the boss and freely moveable within the bowl.

Preferably the said grinder ring, boss and bowl are relatively dimensioned so that when an inner circumferential surface of the grinding ring is in contact with a side wall of the boss an outer circumferential surface of the grinder ring is spaced from the inner surface of the side wall of the bowl, whereby the grinder ring is freely moveable within said bowl.

Preferably said grinder ring has a lower axial end which is disposed nearest said bottom wall when said head is in use, and an opposite upper axial end, and wherein a portion of the outer circumferential surface of said grinder ring adjacent said lower axial end is substantially conical in shape with said portion decreasing in radius in the direction from the lower axial end toward the upper axial end.

Preferably said grinder ring is provided with a handle for manual handling of said grinder ring.

Preferably said handle is in the form of an inflexion formed about the outer circumferential surface of said grinder ring above said substantially conical portion.

Preferably said side wall of said boss and an inner circumferential surface of said grinder ring are relatively shaped to co-act with each other for grinding a portion of the charge therebetween.

Preferably said side wall of said boss and said inner circumferential surface of said grinder ring are relatively shaped so that on contact of said inner circumferential surface of said grinder ring with said side wall of said boss said grinder ring is urged to ride up said boss so that said grinder ring orbits in an inclined plane about aid boss forming a moving zone between said lower axial end of said grinder ring and said bottom wall of the bowl for grinding the charge.

Preferably said boss is detachably fixed to said bottom wall of said bowl.

Preferably said bowl is provided with a side wall or skirt made from a plastics material.

Preferably said bowl includes a lid made of plastics material.

Preferably said lid and said side wall of said bowl are relatively configured to snap fitting together.

Preferably said lid and said side wall are formed as a single integral unit adapted to be fixed to said bottom wall.

In one embodiment, said side wall of said bowl is fixed to bottom wall by integrally moulding said side wall with the bottom wall.

Preferably said lid is shaped to form a receptacle when said bowl is inverted for collecting the ground charge.

According to another aspect of the present invention there is provided a bowl for a grinding head, said bowl including at least:

a side wall or skirt made from a plastics material having first and second axial ends; and, a base plate forming a bottom wall of said bowl against which a charge of material can be ground, said base plate coupled to said second axial end of said side wall or skirt.

According to another aspect of the invention there is provided a base plate for a bowl of a grinding head, the base plate adapted for attachment to a side wall of the bowl and provided on one side with a boss for driving a grinder ring locatable over the boss.

BRIEF DESCRIPTION OF THE DRAWINGS

Embodiments of the present invention will now be described by way of example only with reference to the accompanying drawings in which:

FIG. 9 is a cross sectional view of a seventh embodiment of the grinder head in accordance with the present invention;

FIG. 10 illustrates the grinder head of FIG. 9 in an inverted position;

DETAILED DESCRIPTION OF PREFERRED EMBODIMENTS

Figure 1:
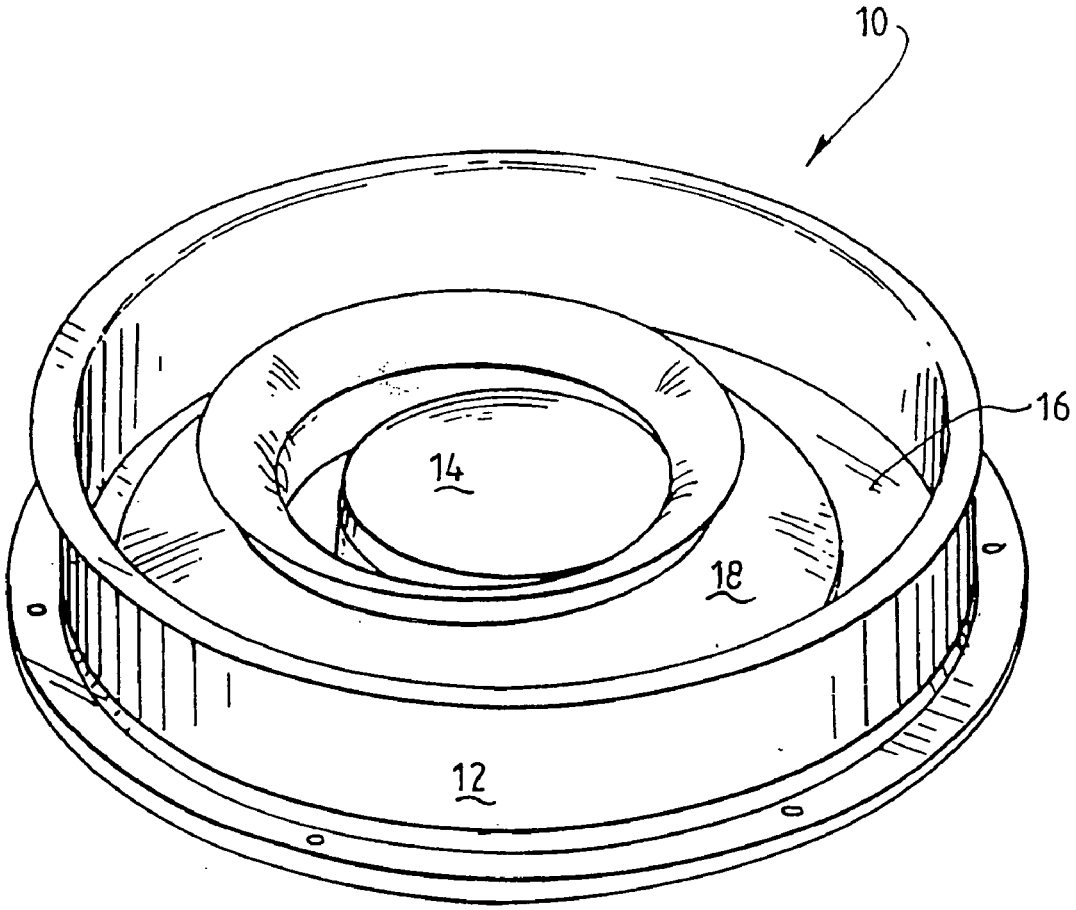
FIG. 1 is a schematic representation of a grinder head in accordance with the present invention but with the lid not shown.
Figure 2:
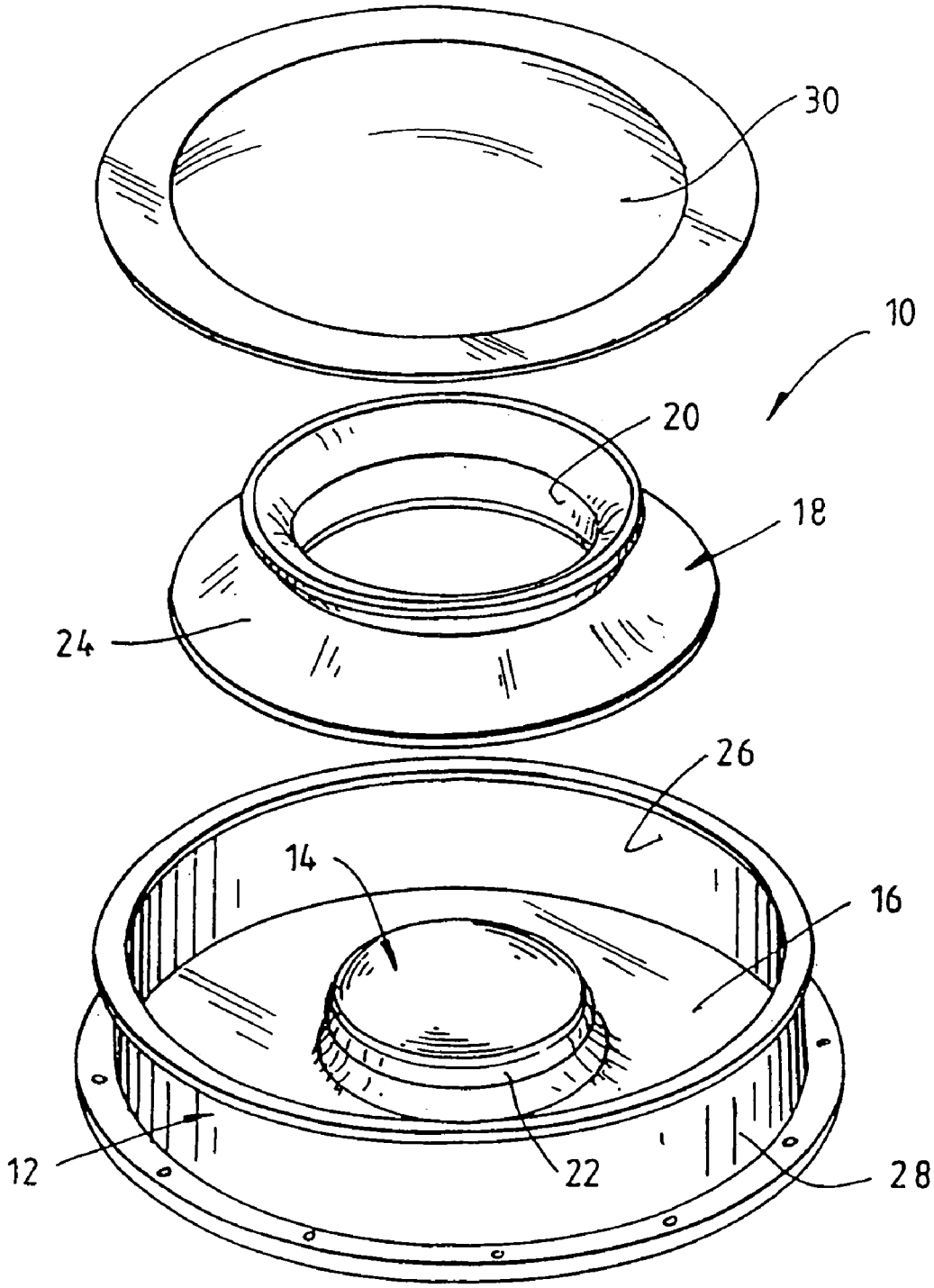
FIG. 2 is an exploded view of the grinder head shown in FIG. 1 but with the inclusion of a lid for the bowl.
Figure 3:
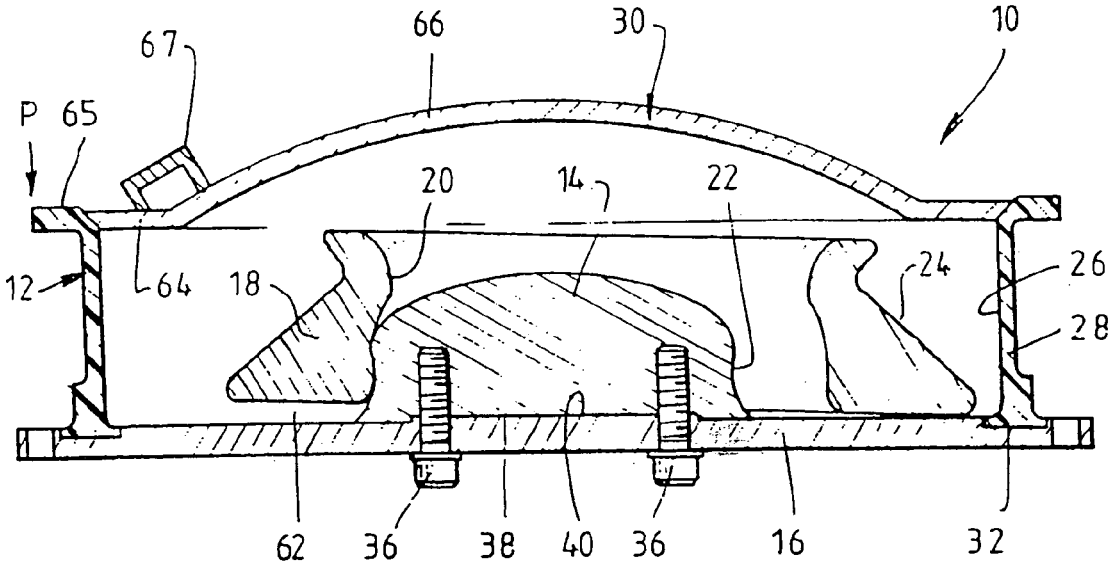
FIG. 3 is a cross sectional view of a first embodiment of the grinder head.

Referring to the accompany drawings and in particular FIGS. 1–3, it will be seen that a grinder head 10 in accordance with an embodiment of the present invention includes a grinding bowl 12 provided with a boss 14 fixed to a bottom wall 16 of the bowl and projecting into the bowl 12. The head 10 also includes a grinder ring 18 that is locatable over the boss 14 and is freely moveable within the bowl 12.

The grinder ring 18 is freely moveable within the bowl 12 because the ring 18 together with the boss 14 and bowl 12 are relatively dimensioned to ensure that when inner surface of the grinder ring 18 comes into contact with side wall 22 of the boss 14 the outer circumferential surface 24 of the grinder ring 18 is spaced from the inner surface 26 of a side wall or skirt 28 of the bowl 12. When the grinder head 10 is placed on a pulverising mill and the mill operated the ring 18 commences to move within the bowl 12 and within a short period of time the inner surface 20 contacts side wall 22 of the boss 14. Thereafter, assuming continued operation of the pulverising mill, the ring 18 is excited into a rotational orbit about the boss 14 by virtue of its contact with the boss 14. Indeed the boss 14 drives the grinder ring 18. Any charge within the grinding head 10 is crushed and pulverised between the grinder ring 18 and the boss 14 and bottom wall 16.

In order to prevent the charge from being ejected from the grinder head 10 when in use, the grinder head 10 is provided with a lid 30 that is adapted to connect with the bowl 12.

By ensuring that the grinder ring 18 does not contact the side wall or skirt 28 of the grinding head 10 there is substantially no wear of the side wall or skirt 28. As a direct result of this the substantial costs incurred in prior art grinder heads and bowls arising from the need to use a large billet of high grade steel can be eliminated. Instead, the present invention gives rise to the ability to use a side wall or skirt 28 made from any material that has physical characteristics sufficient to retain the particles of the charge within the grinder head 10. Thus embodiments of the present invention allow the side skirt 28 to be made from for example, a polymer or other plastics material. The bottom wall 16 will continue to be made from a high grade wear resistant steel or other metal or metal alloy.

Figure 4:
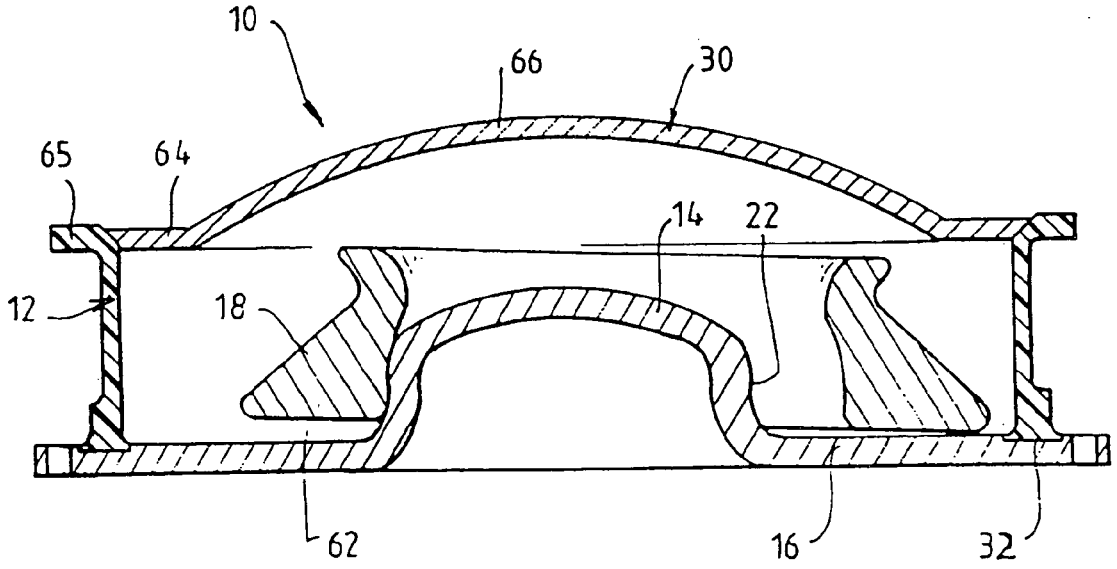
FIG. 4 is a cross sectional view of a second embodiment of the grinder head.
Figure 5:
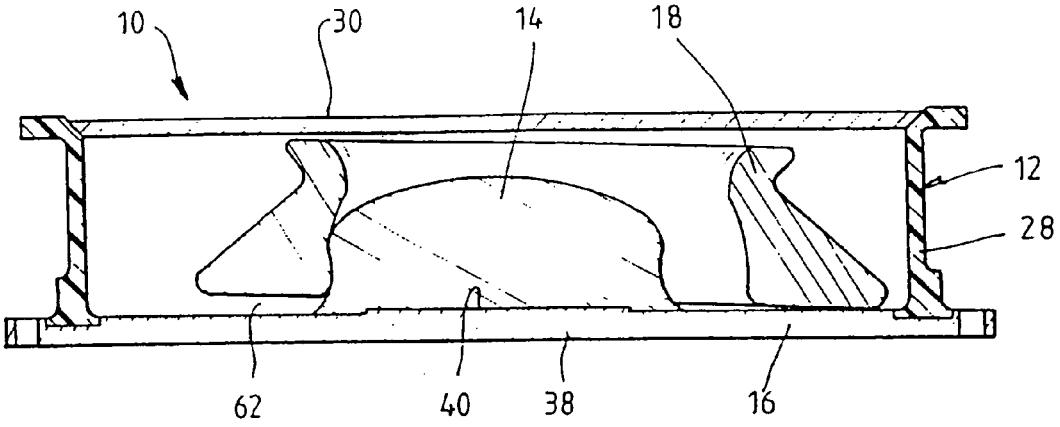
FIG. 5 is a cross sectional view of a third embodiment of the grinder head.
Figure 6:
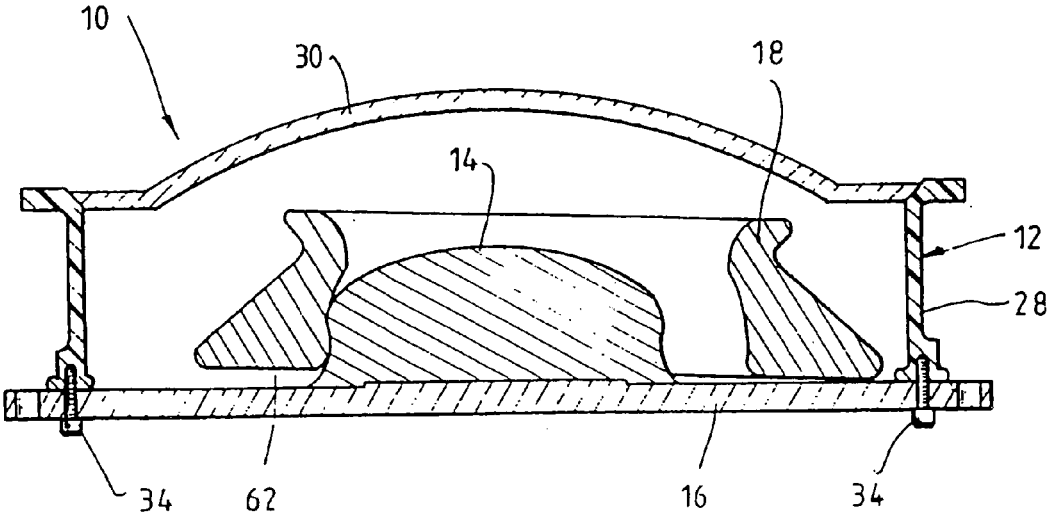
FIG. 6 is a cross sectional view of a fourth embodiment of the grinder head.

As depicted in FIGS. 3, 4 and 5 the side wall 28 is keyed at its lower end to the bottom wall 16. This is achieved by providing a rebated circumferential groove in an upper surface of the bottom wall 16 and moulding the side wall 28 from a plastics material insitu on the groove 32 so that the lower end of the side wall 28 is keyed with the bottom wall 16. However in an alternate embodiment as depicted in FIG. 6, the side wall 28 can be fastened to the bottom wall 16 by use of mechanical fasteners 34 such as bolts or any other means of attachment. Throughout this specification the term "plastics material" is to be given an extended meaning so as to include natural or synthetic rubber compounds, polymers and elastomers.

Returning to FIG. 3, the boss 14 is manufactured separately of the bottom wall 16 and is fastened thereto by bolts 36. The boss 14 is located centrally on the bottom wall 16. To assist in retaining the boss 14 a central portion of the bottom wall 16 is provided with a step 38 that is received within a complimentary recess 40 provided centrally in and inboard of the peripheral edge of a bottom surface of the boss 14 or vice versa.

In an alternate embodiment of the grinder head 10 shown in FIG. 4, the boss 14 is formed integrally with the bottom wall 16 by any suitable known mechanical process such as moulding or stamping. In all other respects the grinding head 10 of FIG. 4 is identical to the grinding head 10 of FIG. 3.

Figure 15:
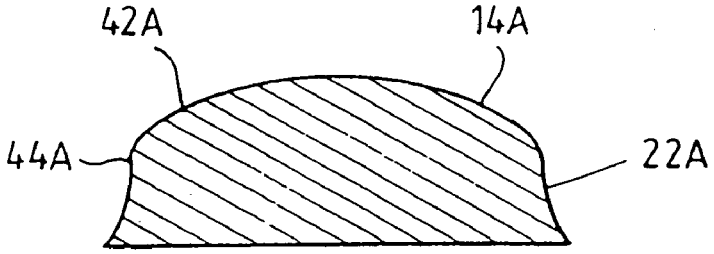
FIG. 15 is a sectional view of a boss used in the grinder head.
Figure 16:
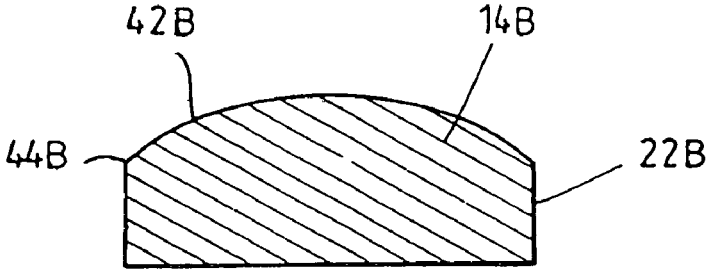
FIG. 16 is a sectional view of a second embodiment of the boss used in the grinder head.

The boss 14 can take many different shapes as highlighted in particular with reference to FIGS. 15, 16, 17 and 18. In FIG. 15, the boss 14A has a convexly curved upper surface 42A and a contiguous side wall 22A that initially has a constant outer diameter but, towards the bottom of the boss 14A smoothly flares outwardly. There is also a smoothly curved transitional zone 44A between the upper wall 42A and the side wall 22A.

The boss 14B shown in FIG. 16 again has a convexly curved upper wall 14B but this time has a side wall 22B of constant diameter for the whole of its length. Additionally, the transition zone 44B is formed with a distinct step or abrupt change in direction between the upper wall 42A, the side wall 22B.

Figure 17:
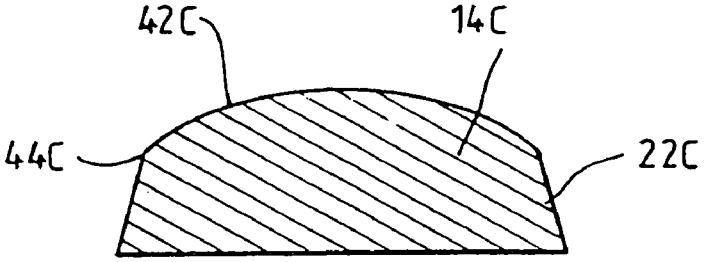
FIG. 17 is a sectional view of a third embodiment of the boss used in the grinder head.

In FIG. 17 the boss 14C differs from boss 14B in that the side wall 22C gradually increases in outer diameter in a direction away from the upper wall 42C.

Figure 18:
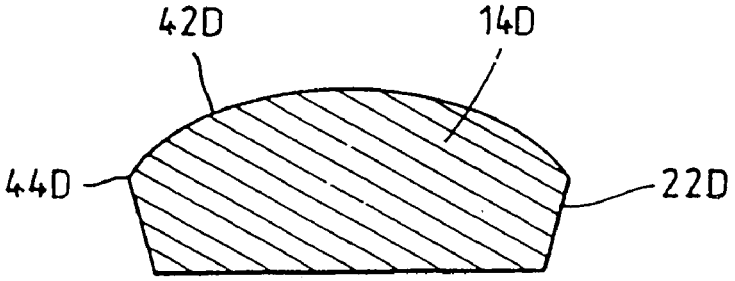
FIG. 18 is a sectional view of a fourth embodiment of the boss used in the grinder head.

In FIG. 18, the side wall 22D of the boss 14D decreases in outer diameter in the direction away from its upper surface 42D.

Figure 11:
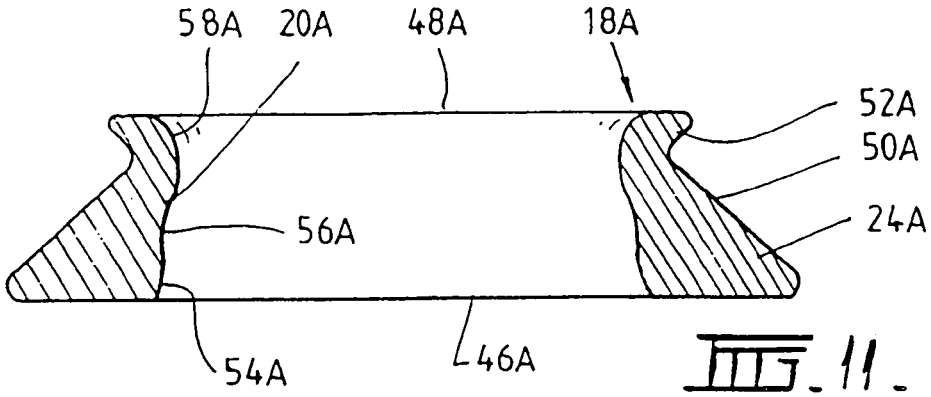
FIG. 11 is a sectional view of a first embodiment of a grinder ring for the bowl.

Various forms of the grinder ring 18 are depicted in FIGS. 11–14 and FIG. 7. Grinder ring 18A depicted in FIG. 11 is identical to the grinding ring 18 depicted in FIGS. 1–6, 9, 10, 19 and 20.

Grinder ring 18A has a lower axial end 46A and an upper axial end 48A. The outer circumferential surface 24A of grinder ring 18A has a first portion 50A adjacent or near the lower axial end 46A that is substantially conical in shape with the radius or diameter of portion 50A decreasing in a direction from the lower axial end 46A toward the upper axial end 48A. Outer circumferential surface 24A also includes another portion 52A that forms an inflexion above the first portion 50. The inflexion extends circumferentially about the outer surface 24A and serves as a handle for gripping the grinder ring 18A.

The inner circumferential surface 20A of grinder ring 18A has, starting from the lower circumferential end 46A, a first portion 54A of substantially constant diameter, a contiguous second portion 56A of smoothly reducing diameter in the direction toward the upper axial end 48A and lastly a contiguous concavely curved portion 58A leading to the upper axial end 48A.

Figure 12:
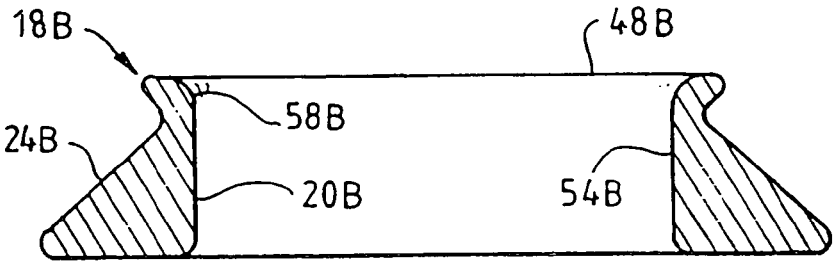
FIG. 12 is a cross sectional view of a second embodiment of a grinder ring for the bowl.

In the embodiments shown in FIG. 12, the grinder ring 18B differs from grinder ring 18A in the shape of the inner circumferential surface 20B. In the grinder ring 18B, the inner circumferential surface 20B has a first portion 54B of substantially constant diameter that is maintained to a point near to the upper axial end 48B at which point the surface 20B is provided with a concavely curved portion 58B.

Figure 13:
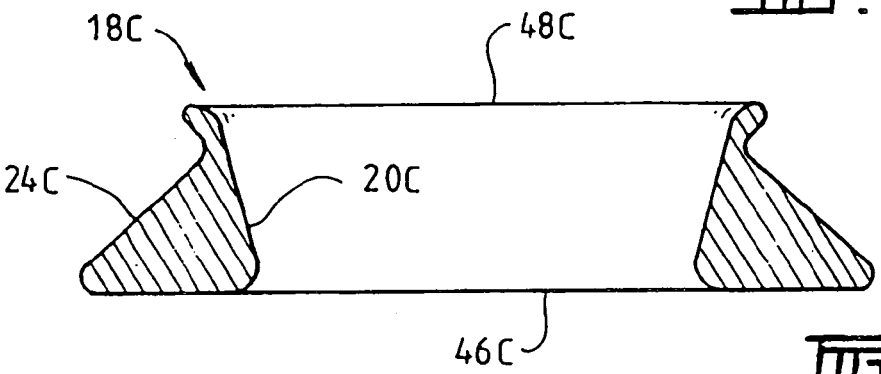
FIG. 13 is a cross sectional view of a third embodiment of a grinder ring for the bowl.

In FIG. 13, the grinder ring 18C differs from the grinder ring 18B in that the inner circumferential surface 20C progressively increases in diameter in the direction from the lower axial end 46C toward the upper axial end 48C.

Figure 14:
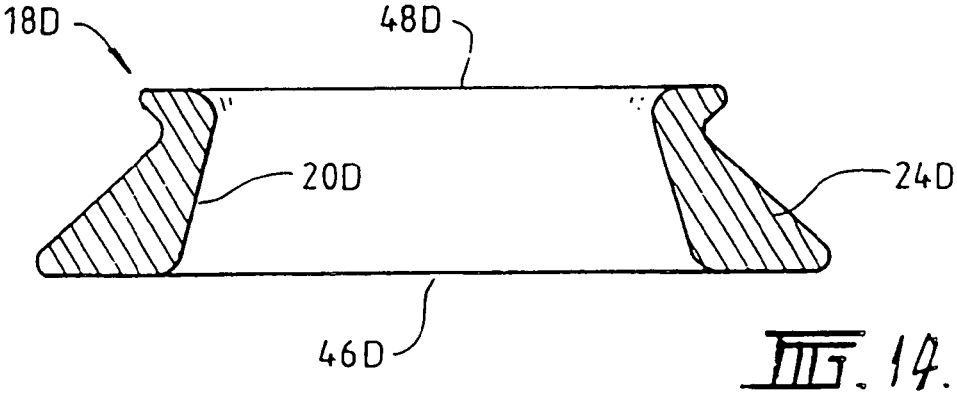
FIG. 14 is a cross sectional view of a fourth embodiment of a grinder ring for the bowl.

In FIG. 14 the grinder ring 18D differs from the grinder ring 18B in that the inner circumferential surface 20D decreases in diameter in the direction from the lower axial end 46D toward the upper axial end 48D.

Figure 7:
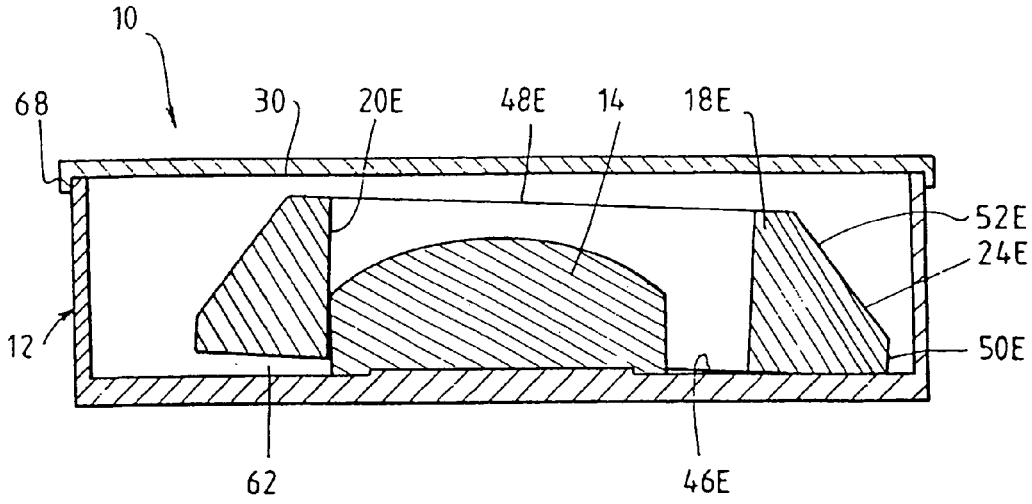
FIG. 7 is a cross sectional view of a fifth embodiment of a grinder head in accordance with the present invention.

In FIG. 7, the grinder ring 18E is of yet a different configuration. Here, the outer circumferential surface 24E has a lower portion 50E adjacent-lower axial end 46E having a constant outer diameter. Outer circumferential surface 24E is then provided with a second contiguous portion 52E that extends from first portion 50E to the upper axial end 48E with a progressively reducing diameter. Additionally, in grinder ring 18E the inner circumferential surface 20E is of constant diameter from the lower axial end 46E to the upper axial end 48E.

Figure 8:
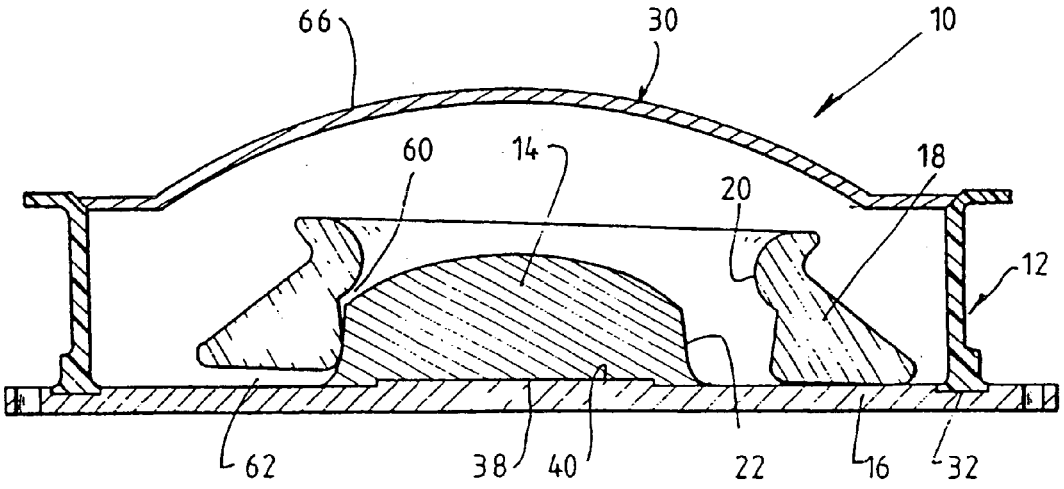
FIG. 8 is a cross sectional view of a grinder head in accordance with a sixth embodiment of the present invention.
Figure 19:
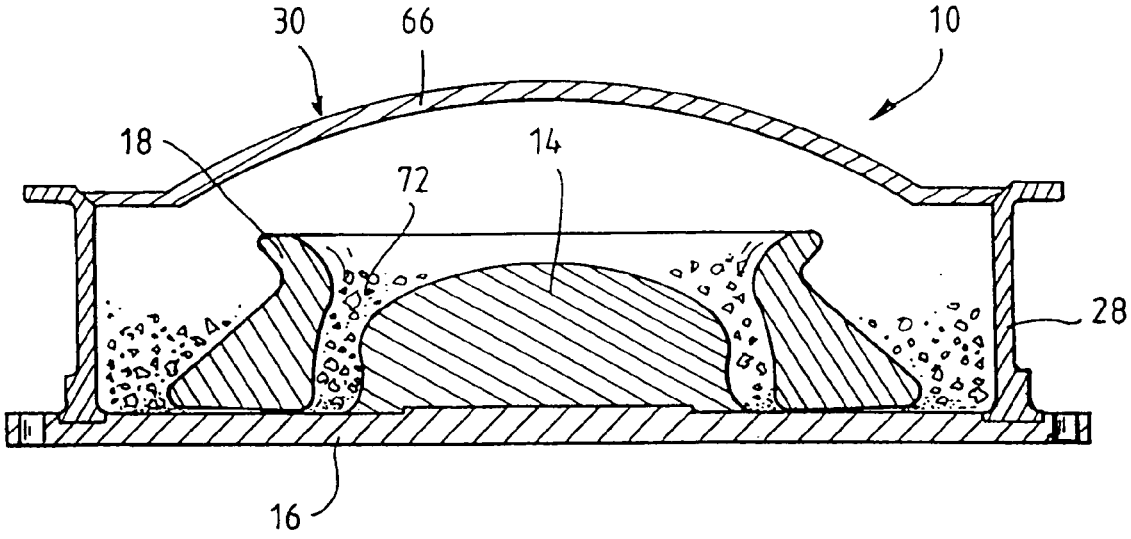
FIG. 19 illustrates and embodiment of the grinder head prior to excitation; and, FIG. 20 is a cross sectional view of the grinder head depicted in FIG. 15 during excitation.
Figure 20:
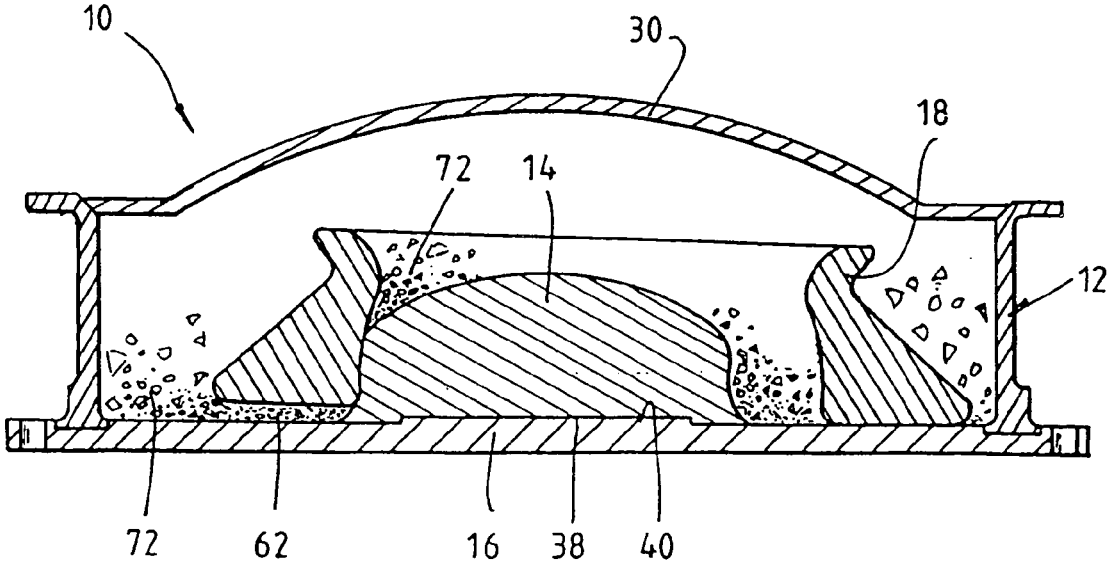

The interaction between the grinder ring 18 and boss 14 is depicted in FIGS. 8, 19 and 20. FIG. 19 shows the head 10 with an ore charge 72 shortly after commencement of operation, prior to the ring 18 contacting the boss 14. FIG. 8 shows the head 10 without any charge but after a period of operation where the ring 18 contacts and is driven by the boss 14. FIG. 20 shows the head 10 at the same time instant as FIG. 8 but with a charge of ore 72. From these figures it can be seen that the inner circumferential surface 20 of the grinder ring 18 and the side wall 22 of the boss 14 are relatively shaped to co-act with each other so that the charge can be ground or pulverised therebetween. It is important to note that the surfaces 20 and 22 need not be perfectly matching or complimentary to each other for their entire length. The only need to co-act to the extent that they can crush or grind a charge therebetween. For example in FIG. 8 a wedge like gap 60 is formed between the surface 20 of ring 18 and the wall 22 of boss 14. Nevertheless, as depicted there is still substantial contact between the surfaces 20 and 22 to ensure co-acting for the purposes of grinding the charge and driving the ring 18.

The deliberate provision of a mismatch in the surfaces 20 and 22 particularly at their lower axial ends is provided to cause the ring 18 to ride up slightly on the boss 14 so that its bottom surface lies in an inclined plane as it orbits about the boss 14. This creates a moving zone 62 as shown in FIG. 20 between the under surface of the ring 18 and the upper surface of bottom wall 16 where further grinding of the charge occurs.

The lid 30 can be formed in many different shapes. For example referring to FIGS. 1–4 the lid 30 has a planar annular portion 64 and a contiguous inner domed portion 66. In FIG. 5, the lid 30 is substantially planar for the entirety of its diameter. In FIG. 7, the lid 30 is provided with a depending peripheral lip 68 for snap fitting onto the outer circumferential surface of the bowl 12. In this regard, in FIGS. 1–5 the lid 30 is configured to snap fit in or onto the inner circumferential surface of the bowl 12. The snap fitting on the inner circumferential surface is configured to form a dust seal to prevent dust created by crushing of the charge to escape from the bowl 12. When the side wall 28 is made from a plastics material, the releasing of the lid 30 from bowl 12 is assisted by pushing down in the manner depicted by arrow P in FIG. 3, on an outer radial edge of a circumferential flange 65 formed about an upper axial end of the side wall 28 and applying a lift action to the handle 67.

The domed portion 66 of the lid 30 can act as a receptacle for the ground charge if the grinder head 10 is inverted. This is highlighted in FIGS. 9 and 10 where the bowl 12 is shown as having an integral side wall 28 and domed lid 30. A hole 68 is formed at the top of the dome 66 and closed with a bung 70.

FIG. 9 depicts an embodiment of the grinder head 10 after a grinding cycle in which the ground charge 72 rests on the bottom wall 16. In FIG. 10 the grinder head of FIG. 9 is inverted. By again shaking or vibrating the inverted grinder head 10 for a short period of time the ground charge 72 falls into a receptacle provided by the inverted dome 66 of the lid 30. To remove the ground sample the bung 70 is pulled from the hole 68. Again vibratory motion can be applied to the inverted lid 30 at this time to assist the ground charge 72 to flow out through the hole 68. Additionally or alternately a vacuum can be used to assist in extraction of the charge 72.

When the same type of material is being ground in the grinder head 10 there is no need to wash the bowl 12, boss 14, or grinder ring 18. In this instance the grinder head 10 after discharging of the ground charge 72 can be simply reinverted to the working position a fresh charge can then be placed in the bowl via the hole 68 and the bung 70 then reinserted into the hole 68. The grinder head 10 can then be operated again and the sequence of events repeated as many times as is necessary.

It will be appreciated that this has significant advantages over the prior art in that it leads to an automatic process in which sample can be automatically loaded into the bowl 12, ground, and then discharged, without any need for manual opening of the bowl 12. removal of the grinder ring 18 and physical extraction of the ground charge 72.

It will be apparent from the above description that embodiments of the present invention enjoy numerous advantages over the prior art. Significantly, the grinder head 10 suffers no substantial wear of the side wall or skirt 28. This provides enormous cost savings as one is not required to constantly replace, the side wall; or, the bowl, in the event that the side wall and bowl are formed integrally. Additionally as there is no substantial wear, the side wall or skirt 28 can be made from a material that is substantially cheaper and lighter in weight than the material conventionally used. In particular the skirt 28 can be made from a polymer or other plastics material. This substantially reduces the total weight of the grinder head 10 making the grinder head 10 easy to handle and reducing the load and thus wear on the pulverising mill. Further, embodiments of the invention also facilitate the use of a polymer plastics snap on lid again leading to reduced cost of the grinder head and decreased weight. It also avoids the need for various clamps or other mechanisms for holding the lid in place as is required in the prior art.

It will also be apparent to those skilled in the relevant arts and numerous modifications and variations may be made to the present invention without departing from the basic inventive concepts. For example, the boss 14 and grinder ring 18 can be made in shapes and configurations other than those depicted. The essential criteria in terms of such configuration is simply that the grinder ring 18 is locatable over the boss 14 and freely moveable within the bowl 12. Naturally forming the boss 14 and grinder ring 18 in different shapes can lead to different degrees of contact between the boss 14 and ring 18. The degree of this contact is able to vary considerably without effecting the performance of the grinder head 10 as grinding occurs in two locations or zones namely between the inner circumferential surface 20 and the side wall 22 as well as between the under surface of the ring 18 and the bottom wall 16. Also, different types of mechanisms can be used for attaching the lid 30 to the side wall 28. For example integrally moulded clips on the lid 30 can be provided to clip onto the side wall 28. While the side wall 28 is largely described as being able to be made from a plastics material it can also advantageously be made from an elastomer. Further, since the side wall 28 does not need to bear any load and is not impacted on by the grinder ring 18 it can also be made from non wearing, non load bearing materials such as thin tin plate, stiff paper, or cardboard.

In the described embodiments, the boss 14 is depicted as being located centrally on the bottom wall 16 however it can be located off centre. Similarly, while the inner and outer circumferential surfaces 20 and 24 of ring 18 are depicted as being cocentric they may be eccentric.

All such modifications and variations are deemed to be within the scope of the present invention the nature of which is to be determined from the above description and the appended claims.

What is claimed is:

1. A grinder head comprising:

a grinding bowl for holding a charge of material to be ground and having a restraining boss fixed to a bottom wall of the bowl and projected into the bowl; and, a grinder ring locatable over the boss and freely moveable within the bowl, said grinding ring having an outer circumferential surface and an inner circumferential surface surrounding an opening, the restraining bos received within the opening for limiting movement of the grinding ring, said grinder ring, boss and bowl being relatively dimensioned so that when the inner circumferential surface of the grinding ring contacts a side wall of the boss, the outer circumferential surface of the grinder ring is spaced away from the inner surface of the side wall of the bowl, whereby the grinder ring is freely moveable within said bowl but is prevented from contacting the side wall of the bowl.

2. The grinder head according to claim 1 wherein said grinder ring has a lower axial end which is disposed nearest said bottom wall when said head is in use, and an opposite upper axial end, and wherein a portion of the outer circumferential surface of said grinder ring adjacent said lower axial end is substantially conical in shape, the conical shaped portion decreasing in a direction from the lower axial end toward the upper axial end.

3. The grinder head according to claim 1 wherein said grinder ring is provided with a handle for manual handling of said grinder ring.

4. The grinder head according to claim 3 wherein said handle is in the form of an inflexion formed about an outer circumferential surface of said grinder ring above a substantially conical shaped portion thereof.

5. The grinder head according to claim 1 wherein said side wall of said boss and an inner circumferential surface of said grinder ring are relatively shaped to co-act with each other for grinding a portion of the charge therebetween.

6. The grinder head according to claim 1 wherein said side wall of said boss and said inner circumferential surface of said grinder ring are relatively shaped so that on contact of said inner circumferential surface of said grinder ring with said side wall of said boss said grinder ring is urged to ride up said boss so that said grinder ring orbits in an inclined plane about said boss, forming a moving zone between a lower axial end of said grinder ring and said bottom wall of the bowl for grinding the charge of material.

7. The grinder head according to claim 1 wherein said boss is detachably fixed to said bottom wall of said bowl.

8. The grinder head according to claim 1 wherein said bowl has a side wall made from a plastic material.

9. The grinder head according to claim 1 wherein said bowl has a lid made of a plastic material.

10. The grinder bead according to claim 9 wherein said lid and said side wall of said bowl are relatively configured to be snap fit together.

11. The grinder head according to claim 9 wherein said lid and said side wall are formed as a single integral unit adapted to be fixed to said bottom wall.

12. The grinder head according to claim 8 wherein said side wall of said bowl is fixed to said bottom wall by integrally molding said side wall with the bottom wall.

13. The grinder head according to claim 9 wherein said lid is shaped to form a receptacle when said bowl is inverted for collecting the ground charge.

* * * * *

UNITED STATES PATENT AND TRADEMARK OFFICE

CERTIFICATE OF CORRECTION

PATENT NO. : 6,935,585 B1
DATED : August 30, 2005
INVENTOR(S) : Barry Reginald Hobson It is certified that error appears in the above-identified patent and that said Letters Patent is hereby corrected as shown below:

Column 8,
Lines 38 and 42, change “Grinding” to -- Grinder --;
Line 40, change “Grinding” to -- Grinder --, change “Bos” to -- Boss --.

Signed and Sealed this

Seventh Day of March, 2006

JON W. DUDAS
*Director of the United States Patent and Trademark Office*